US006715250B2

(12) United States Patent
Bryant et al.

(10) Patent No.: US 6,715,250 B2
(45) Date of Patent: Apr. 6, 2004

(54) PLASTIC SIDING PANEL

(75) Inventors: David A. Bryant, Mount Sterling, OH (US); Daniel J. Ernst, Sidney, OH (US); George A. Griman, Sidney, OH (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/186,939

(22) Filed: Jun. 28, 2002

(65) Prior Publication Data

US 2002/0189187 A1 Dec. 19, 2002

Related U.S. Application Data

(60) Continuation-in-part of application No. 09/766,024, filed on Jan. 19, 2001, now Pat. No. 6,421,975, which is a division of application No. 09/392,004, filed on Sep. 8, 1999, now Pat. No. 6,224,701.

(51) Int. Cl.[7] ..... E04D 1/08

(52) U.S. Cl. ..... 52/528; 52/522; 52/523; 52/544; 52/553; 52/555; 52/573.1

(58) Field of Search ..... 52/309.1, 520, 52/522, 523, 527, 528, 529, 543, 544, 546, 547, 553, 555, 573.1

(56) References Cited

U.S. PATENT DOCUMENTS 4,680,911 A * 7/1987 Davis et al. ..... 52/521
4,695,033 A 9/1987 Imaeda et al.
4,712,351 A 12/1987 Kasprzak
5,249,402 A * 10/1993 Crick et al. ..... 52/533
5,347,784 A * 9/1994 Crick et al. ..... 52/520
5,537,792 A * 7/1996 Moliere ..... 52/531
5,644,886 A * 7/1997 Ekmark et al. ..... 52/518
5,675,955 A * 10/1997 Champagne ..... 52/521
5,956,914 A * 9/1999 Williamson ..... 52/520
6,212,843 B1 4/2001 Kalkanoglu et al.
6,224,701 B1 5/2001 Bryant et al.
6,336,303 B1 * 1/2002 Vandeman et al. ..... 52/520
6,421,975 B2 7/2002 Bryant et al.

* cited by examiner

*Primary Examiner*—Brian E. Glessner
(74) *Attorney, Agent, or Firm*—Glenn E. Klepac

(57) ABSTRACT

A plastic panel for attachment to an exterior wall of a building includes a body, an attachment hem attached to the body and defining at least one aperture for a fastener, and a side flange extending laterally outwardly of the body. The side flange defines a fastening slot for attaching the panel to a building wall. The fastening slot extends at a predetermined acute angle relative to horizontal, preferably about 10–20° relative to horizontal, and about 15° in a particularly preferred embodiment. The fastening slot is preferably elongated and narrow so that the head of a metal fastener extends over opposed upper and lower edges of the slot.

9 Claims, 7 Drawing Sheets

PLASTIC SIDING PANEL

RELATED APPLICATION

This application is a continuation-in-part of U.S. Ser. No. 09/766,024 filed Jan. 19, 2001 (now U.S. Pat. No. 6,421,975 issued Jul. 23, 2002), which is a division of U.S. Ser. No. 09/392,004, filed Sep. 8, 1999 (now U.S. Pat. No. 6,224,701 issued May 1, 2001).

FIELD OF THE INVENTION

The present invention relates to plastic siding panels for covering exterior walls on buildings.

BACKGROUND OF THE INVENTION

Molded plastic siding panels for exterior building walls are known in the prior art. These molded panels are made from synthetic thermoplastic polymers, including polypropylene, polyethylene, and various mixtures and copolymers thereof.

Laterally elongated molded plastic panels are nailed to a wall support surface in horizontal rows partially overlapping each other in order to provide a pleasing appearance combined with a water-resistant protective layer over the support surface.

The molded plastic panels are typically installed by nailing several adjacent courses to a wall support surface, starting with a bottom course. A lower marginal edge region of each panel in courses above the bottom course overlaps a panel in the course immediately below. Side marginal edge regions of each panel overlap side marginal regions of adjacent panels.

The plastic panel of the present invention is fastened to a building wall by means of metal fasteners inserted through apertures on a nailing hem and through a fastening slot on a side flange. A principal objective of our invention is to provide a fastening slot that avoids fracturing or bowing of the panel when it contracts and expands in response to temperature changes.

A related objective of the invention is to provide a molded plastic panel having side marginal edge regions for interlocking laterally adjacent plastic panels without bowing or fracturing the panel during installation or upon thermal expansion and contraction.

A further objective of the invention is to camouflage spacings of varying width between adjacent panels resulting from thermal expansion and contraction.

Another objective of the invention is to provide a process for making a molded plastic panel including an attachment hem having at least one locking tab, without any through openings in the attachment hem behind the locking tab.

Additional objectives and advantages of the invention will become apparent to persons skilled in the art from the following detailed description.

SUMMARY OF THE INVENTION

In accordance with the present invention, there is provided a thermoplastic panel for covering exterior walls on buildings. The panel is made from a thermoplastic polymer selected from the group consisting of polyolefins, polycarbonate, polyvinyl chloride, and mixtures and copolymers thereof. Polyolefins, especially polypropylene in mixtures and copolymers with polyethylene, are particularly preferred. The thermoplastic panel is preferably manufactured by injection molding.

The thermoplastic panel includes a body, an attachment hem or nailing hem adjacent an upper portion of the body, a locking tab attached to the attachment hem, a bottom flange attached to a lower portion of the body, and at least one side flange extending laterally outwardly of the body.

The attachment hem is preferably adjacent an upper portion of the body. The attachment hem defines a plurality of spaced, laterally elongated attachment apertures or nailing apertures for attaching the panel to an exterior building wall.

A locking tab attached to the hem includes a downwardly extending lower leg portion and a forwardly extending upper leg portion connecting the hem with the lower leg portion.

A bottom flange attached to a lower portion of the body includes an upwardly extending locking lip for engaging a locking tab on an adjacent panel.

The panel body includes at least one laterally extending row of simulated shingles. The shingles each have a bottom wall extending between two side walls, and a front surface protion including a bottom end portion adjacent the bottom wall and a top end portion spaced upwardly from the bottom wall.

A particularly preferred panel body includes an upper row and a lower row of simulated shingles. A ledge, generally coplanar with the bottom wall of the upper row of shingles, extends rearwardly of the bottom end portion.

A lead fin extends laterally outwardly of the upper row of simulated shingles. The lead fin has a lateral end spaced laterally outwardly of the upper row. A groove below the lead fin extends between the lateral end and the upper row. Plastic panels of the invention fit together with a middle ledge of a first panel engaging a lead fin of a second panel adjacent the first panel.

A particularly preferred plastic panel includes at least one laterally extending row of simulated shingles having a simulated wood appearance. A panel with two rows of simulated shingles is most preferred. The simulated shingles each include a bottom wall extending between longitudinally extending shingle side walls. The side walls preferably are generally parallel to each other and parallel to adjacent side walls on other shingles in each row.

Opposed side walls on adjacent simulated shingles define a plurality of gaps each having a predetermined width, defined herein as the average distance between opposite side walls. These gaps each have a width that varies randomly within predetermined limits in order to camouflage the lateral spacings between adjacent panels that vary because of thermal contraction and expansion. For example, systems mounted with ¼ inch average lateral spacings between shingles in adjacent panels will have gaps between adjacent simulated shingles averaging about a ¼ inch width. However, the gap width varies randomly between about ⅛ inch and ⅝ inch, thereby camouflaging spacings that vary because of thermal contraction and expansion.

In a preferred embodiment of the invention, the plastic panel is injection molded to include a body having side walls on opposite lateral sides, a top wall extending between the side walls, and an elongated strip extending outwardly of the top wall. The strip includes a locking tab spaced from the top wall and a laterally extending folding hinge between the locking tab and the top wall. The folding hinge extends between the side walls and has reduced thickness compared with the remainder of the strip.

The strip is folded along the folding hinge so that adjacent opposed surfaces on the strip define a fastening line. The opposed surfaces are then joined together by heat or ultrasound or mechanically to form an integral structure.

An important advantage of the invention is that the locking tab is continuous, extending without interruption between the side walls and without any openings behind the locking tabs.

The attachment hem defines at least one aperture, and preferably several apertures, for fasteners to attach the plastic panel to a building wall. At least one side flange extends laterally of the body, preferably laterally of a lower row of the simulated shingles. The side flange defines a fastening slot for inserting a fastener therethrough to attach the panel to a building wall.

The fastening slot extends at a predetermined acute angle relative to horizontal. More specifically, the fastening slot extends at an angle of about 5–30° relative to horizontal, preferably about 10–20°, and about 15° in a particularly preferred embodiment wherein the panel has dimensions of about 64 in×14 in. The fastening slot is preferably narrow and elongated, extending between opposed, upper and lower marginal edges. The head of a metal fastener extending through the slot overlaps both the upper and lower marginal edges.

DETAILED DESCRIPTION OF THE PREFERRED EMBODIMENT

Figure 1:
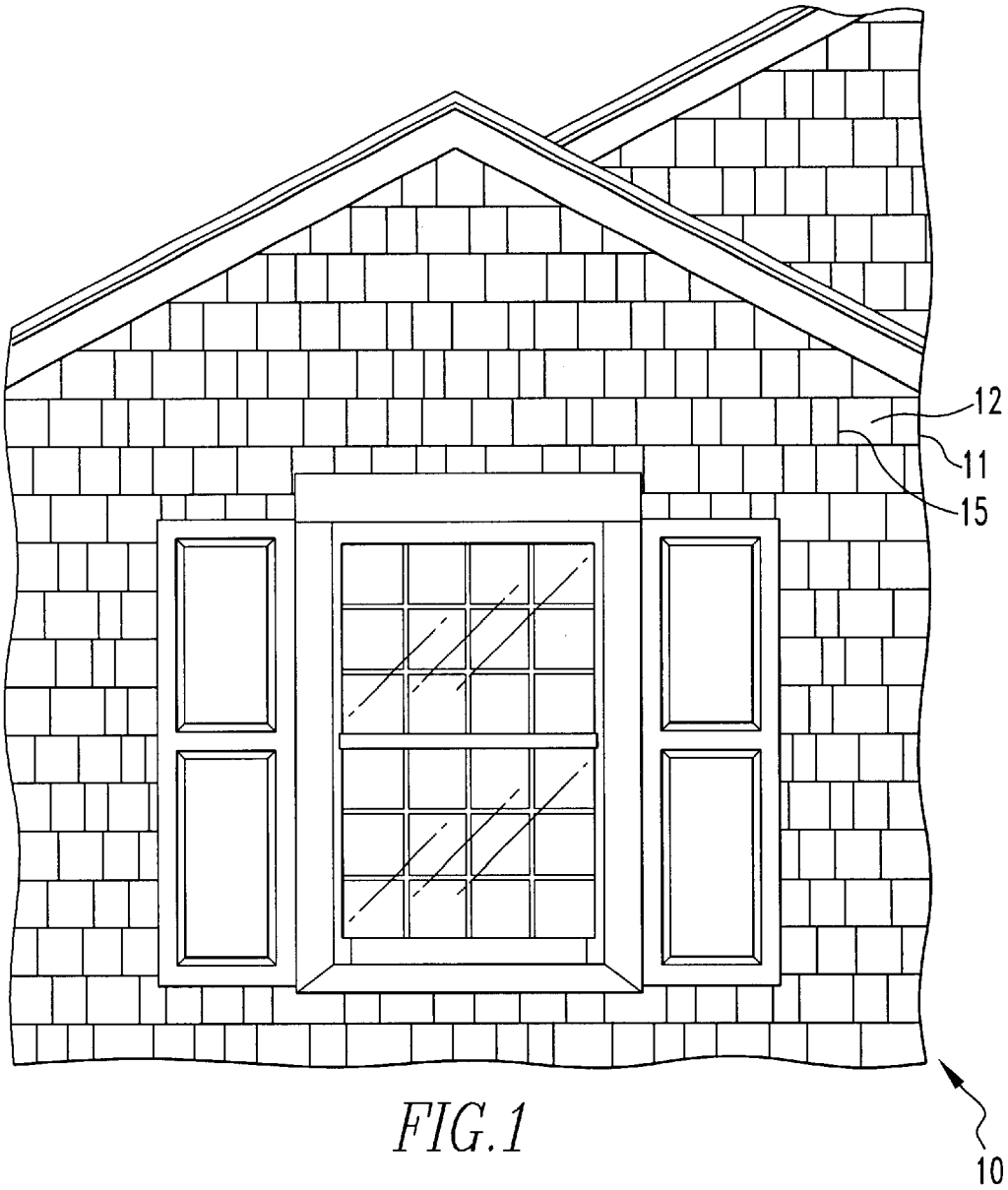
FIG. 1 is a fragmentary front elevational view of a building wall covered with plastic panels made in accordance with the present invention.

The present invention is directed to an improved molded plastic siding panel for covering exterior walls on buildings. Referring now to the drawings, there is shown in FIG. 1 an exterior wall 10 covered by several plastic panels 11 of the invention. The panels 11 each include two laterally extending generally parallel rows of simulated wood shingles 12. The shingles 12 have irregular widths and they are separated from shingles in the same row by vertically extending gaps 15 of varying width. The panels 11 may cover an entire exterior wall as shown in FIG. 1 or they may be combined with other exterior wall coverings such as vinyl siding, or with various other materials including brick, aluminum, ceramic tile, and the like.

Figure 2:
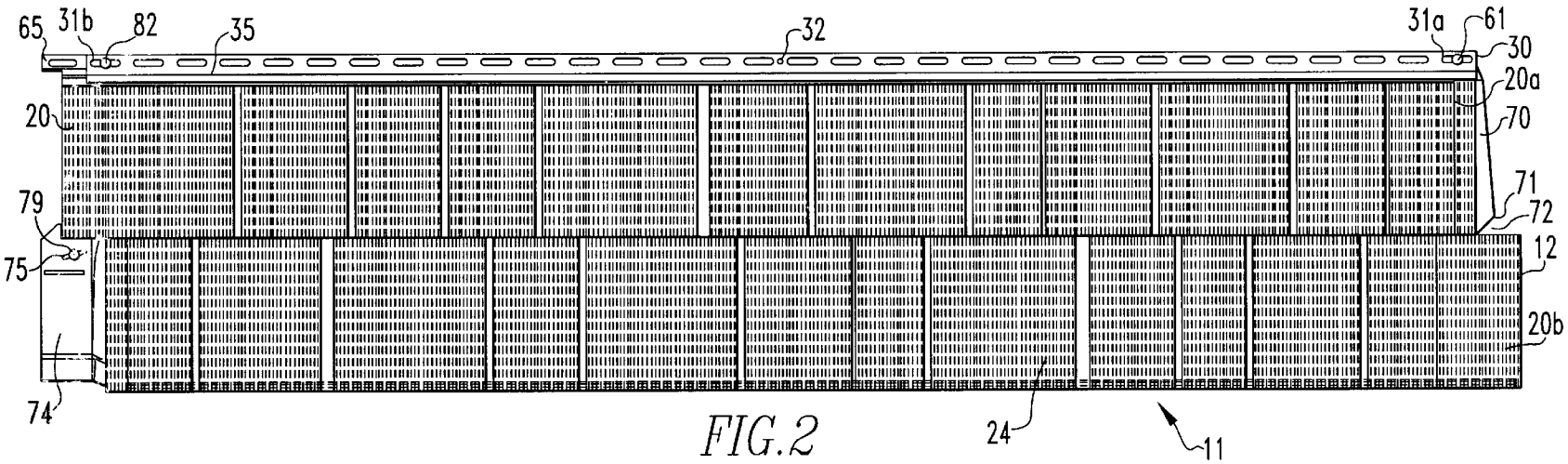
FIG. 2 is a front elevational view of a plastic siding panel of the invention.
Figure 3:
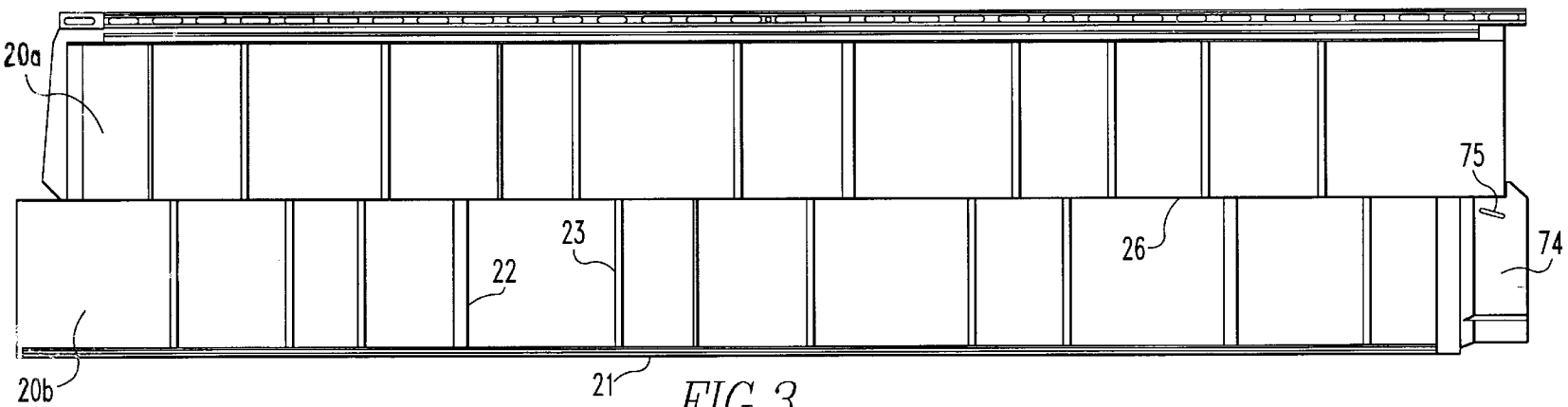
FIG. 3 is a rear elevational view of the plastic siding panel of FIG. 2.

One of the panels 11 is shown in greater detail in FIGS. 2–4. The panel 11 includes a body 20 divided into two generally parallel, laterally extending rows 20*a*, 20*b* of simulated wood shingles 12. The shingles 12 in the lower row 20*b* each include a bottom wall 21 extending between opposed side walls 22, 23 and a front wall or front surface portion 24 extending upwardly from the bottom wall 21. Shingles 12 in the upper row 20*a* also include a top wall 25. A laterally extending middle wall 26 extends between the upper row 20*a* and the lower row 20*b*.

Opposed side walls 22, 23 on adjacent simulated shingles 12 define gaps 15 of varying width. Width of the gaps 15 varies randomly within predetermined limits in order to camouflage spacings between adjacent panels accompanying thermal contraction and expansion. In prior art panels having identical or nearly identical shingle gaps, the spacings between adjacent panels are more readily noticeable.

As shown in FIGS. 2 and 3, the panel 11 also includes an attachment hem or nail hem 30 adjacent the top wall 25. The nail hem 30 defines several laterally elongated, laterally spaced nail apertures 31 for nailing the panel 11 to a building wall. The nail hem 30 also includes a center hole spot 32 for locating a centered nail, as described in more detail below.

Figure 4A:
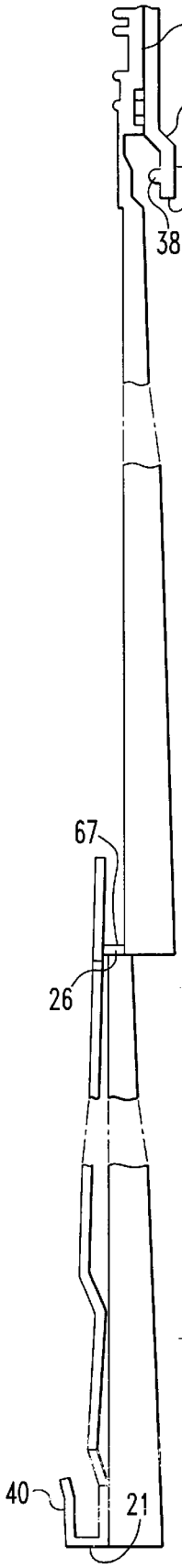
FIG. 4*a* is a left side elevational view of the plastic panel of FIG. 2.
Figure 4B:
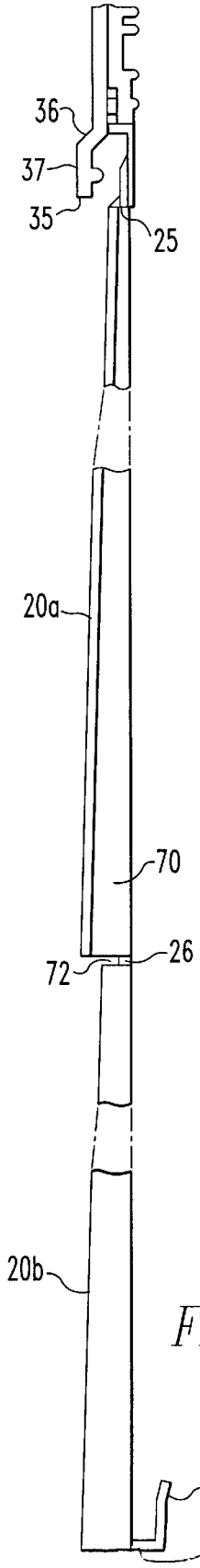
FIG. 4*b* is a right side elevational view of the plastic panel of FIG. 2.

Referring now to FIGS. 4*a* and 4*b*, a continuous locking tab 35 is attached to the hem 30. The locking tab 35 includes a forwardly extending upper leg portion 36 adjacent the hem 30 and a downwardly extending lower leg portion 37. The lower leg portion 37 includes a rearwardly directed plug 38 for connection with a flange 40 on an upwardly adjacent panel.

A bottom wall 21 of the lower row 20*b* extends rearwardly of the body 20. The bottom wall 21 supports an upwardly directed flange or locking flange 40 for connection with a locking tab 35 on a downwardly adjacent panel.

Figure 5:
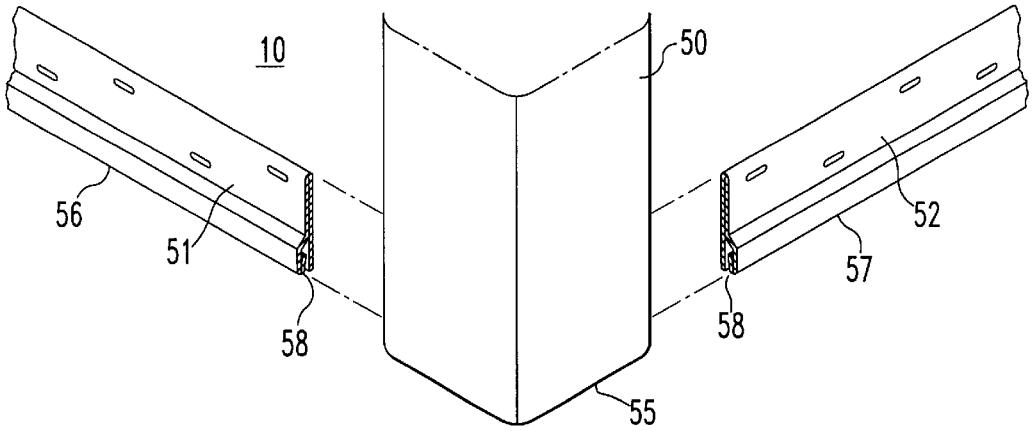
FIG. 5 is a fragmentary, perspective view of an exterior building wall.

As shown in FIG. 5, a plastic corner post 50 and metal starter strips 51, 52 are installed on an exterior building wall 10 before the panels are hung. Alternatively, the corner post 50 may be made from an aluminum alloy or other metal, and the starter strips 51, 52 may be made from polyvinyl chloride or other plastic material. The corner post 50 has a bottom edge 55 extending below lower edges 56, 57 of the starter strips 51, 52. A lateral spacing of about ½ inch is provided between the corner post 50 and the starter strips 51, 52 in order to allow for thermal expansion. The starter strips each include a downwardly opening groove 58 that will engage flanges on the plastic panels.

Figure 6:
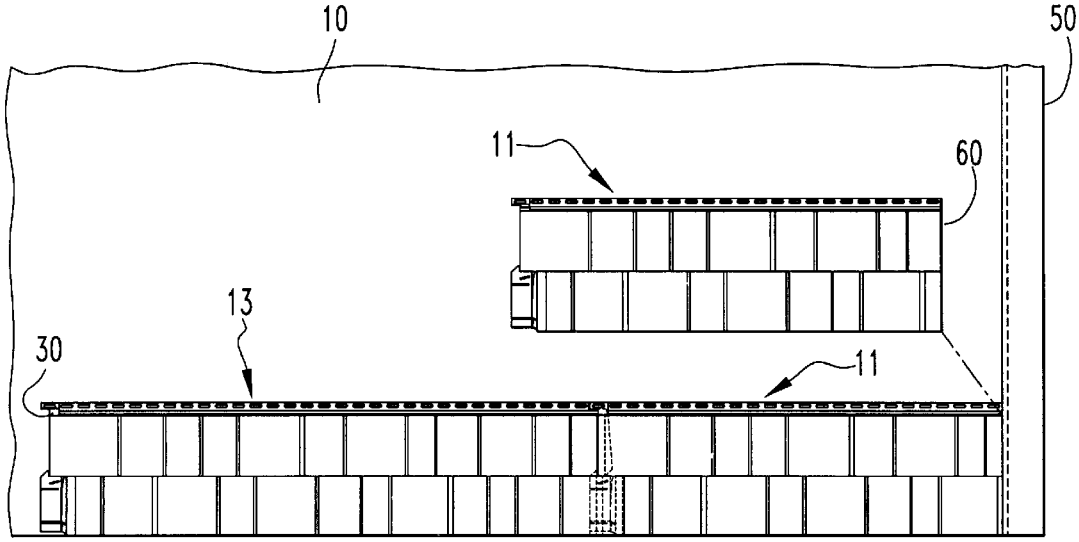
FIG. 6 is a fragmentary, front elevational view of an exterior building wall covered with plastic siding panels of the invention.

Referring now to FIG. 6, the plastic panels 11, 13 are hung on a wall 10 starting by making a vertical cut on the right side of a first panel 11, resulting in a right edge 60 extending about ¼ inch into the corner post 50. A ¼ inch clearance into the corner post 50 allows for panel movement caused by temperature changes. A second panel 13 is hung to the left of the first panel 11, with edge portions of the two panels 11, 13 interlocking. An alignment gauge 65 on the nail hem 30 (shown in FIG. 2) determines the location of the next panel, based upon temperature during installation.

As shown in FIGS. 2–4*b*, the panels 11 include an upper row 20*a* and a lower row 20*b* of simulated shingles. The upper row 20*a* has a middle wall 26 extending rearwardly and having a top surface comprising a middle ledge 67. The panel 11 also includes a lead fin 70 having a lateral end 71 extending laterally outwardly of the upper row 20*a* and a groove 72 below the lead fin 70. The lower row 20*b* has a side flange 74 extending leftwardly. The side flange 74 includes a nail slot 75 for nailing the flange 74 to the wall 10. The nail slot 75 extends at about a 15° angle relative to horizontal in the preferred embodiment shown. The angle of the nail slot 75 varies, depending upon dimensions of the panel and the location of the nail slot 75. In the preferred embodiment of FIGS. 2–4 wherein the panel has a half-length of about 32 in and a half-height of about 7 in and the nail slot 75 is located adjacent a side below the middle wall 26, a 15° angle is quite suitable. This predetermined angle will generally be larger than 15° in panels having a larger ratio of height to length, smaller than 15° in panels having a smaller ratio of height to length.

Figure 9:
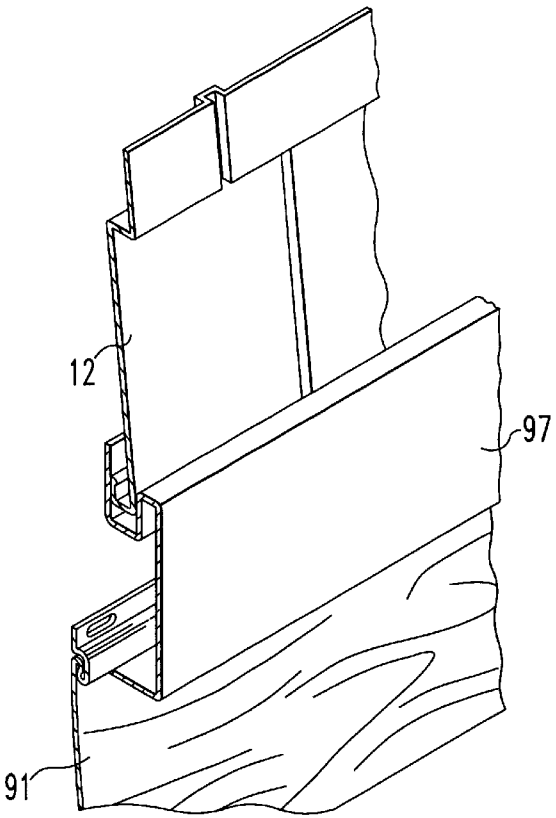
FIGS. 7–9 are fragmentary perspective views of transition regions between a plastic siding panel of the present invention and a conventional siding panel.
Figure 8:
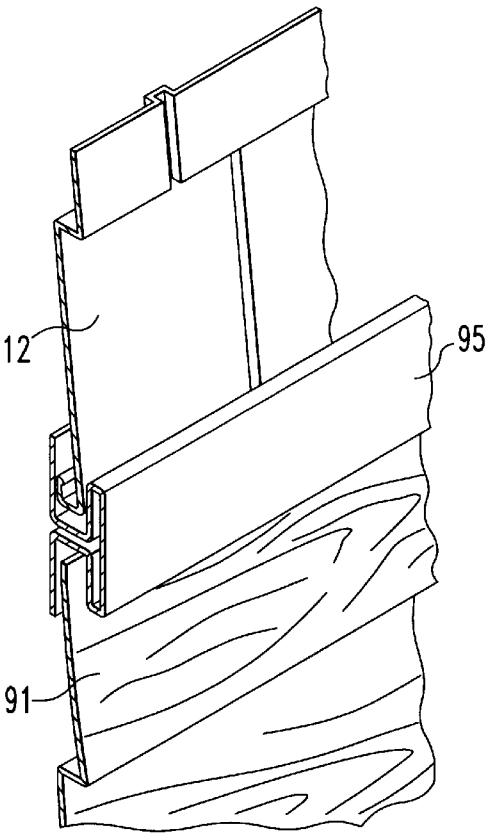
Figure 7:
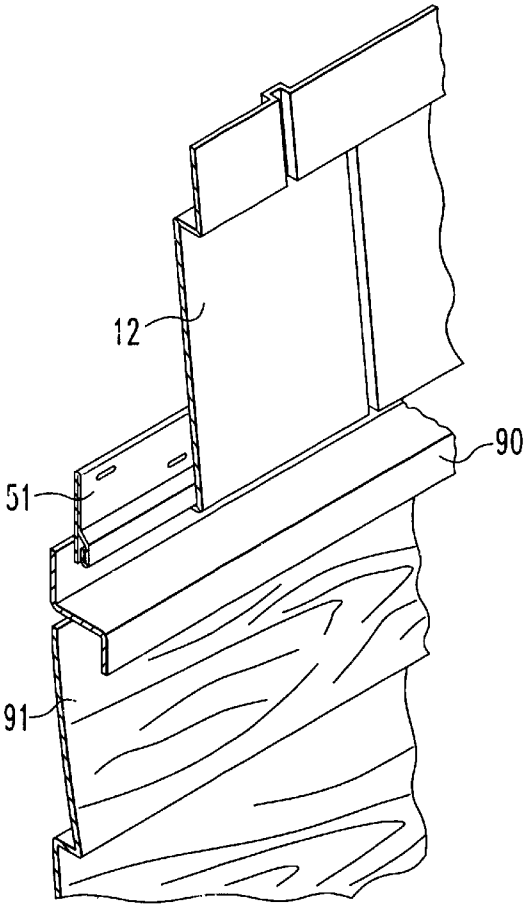

Various options for installing molded plastic panels of the invention adjacent courses of conventional vinyl siding panels are shown in FIGS. 7, 8 and 9. In FIG. 7, a drip cap 90 and a starter strip 51 are positioned between the vinyl siding panel 91 and the molded plastic panel 12.

In FIG. 8, a T-channel 95 is installed between the vinyl siding panel 91 and the molded plastic panel 12.

In FIG. 9, a lineal 97 is installed between the vinyl siding panel 91 and the molded plastic panel 12.

Figure 10:
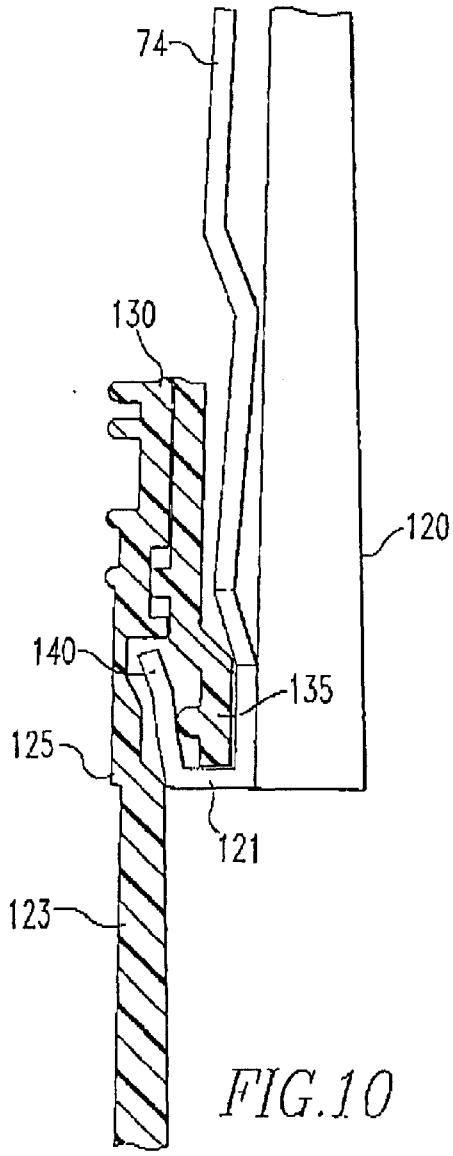

A particularly preferred plastic panel 101 of our invention is shown in FIG. 10. The panel 101 includes a plastic body 120 having a bottom wall 121 serving as a hinge support web for a locking flange 140. The flange 140 is connected. with a locking tab 135 on an adjacent panel 123. The panel 123 also has an attachment hem or nail hem 130 adjacent a top wall 125.

Figure 11:
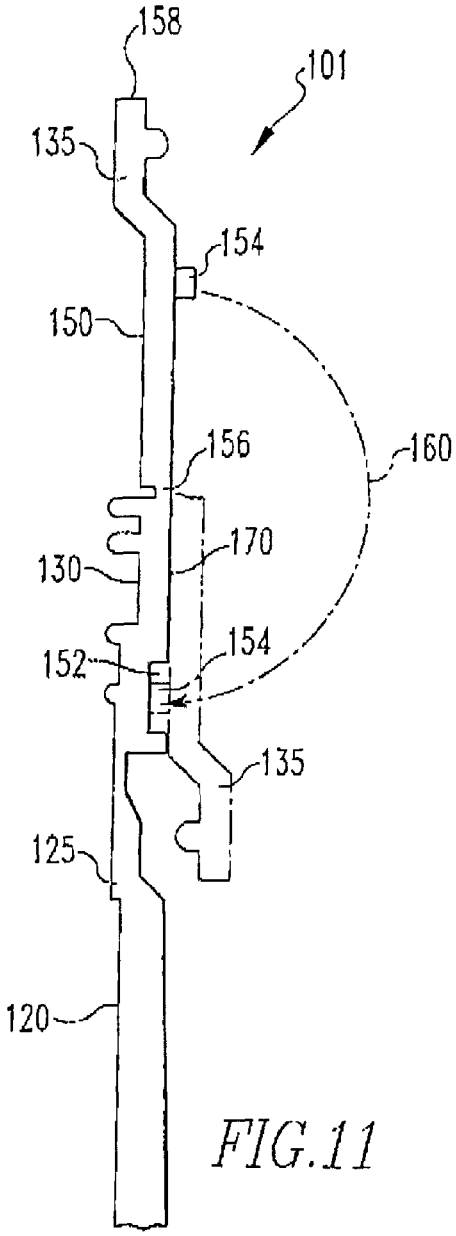
FIGS. 10 and 11 are fragmentary, side elevational views of a particularly preferred embodiment of the invention.

As shown in FIG. 11, the hem 130 and locking tab 135 are manufactured by a process in which the hem 130 and locking tab 135 are initially injection molded as an elongated strip 150 extending outwardly from the top wall 125. The strip 150 connects a locking tab 135 to the top wall 125. The strip 150 includes a boss 154. A narrow folding hinge or folding area 156 extends about halfway between the top wall 125 and the top end 158 of the strip 150. The folding hinge typically has a thickness of about 0.010 to 0.020 inch.

After the strip 150 is molded, the top end 158 is folded in the direction of the arrow 160 shown in FIG. 11 so that the boss 154 fit inside a shallow depression 152. Finally, after the strip 150 is folded over as shown in FIG. 11, opposed surfaces along the fastening line 170 are joined together by heat or ultrasound or by mechanical means to provide an integral structure.

The single locking tab 135 shown in FIGS. 10 and 11 preferably extends across the entire width of the panel 101. In contrast, prior art locking tabs each have a width of only about 2 inches, separated by spacings of about 3½ inches. The hem 130 shown in FIG. 11 is preferably continuous, uninterrupted by any through openings behind the locking tab 135. The locking tab 135 extends between spaced lateral ends of the attachment hem 130.

Referring again to FIG. 2, a required nailing sequence for the panels 11 is as follows. Initially, a first nail 61 is driven through a center of a nail aperture 31*a* at the right end of the panel 11. Next, a second nail 82 is nailed through another aperture 31*b* near the left end of panel 11. This second nail 82 must not be driven through the leftmost aperture. Next, a third nail 79 is driven through the nail slot 75 in the left side flange 74. Fourth, a fourth nail (not shown) is driven through the center hole spot 32 at the center of the attachment hem 30. Finally, additional nails (not shown) are driven through other nail apertures 31 in the hem 30 at intervals of about 8 inches, thereby assuring maximum wind load resistance.

Figure 12:
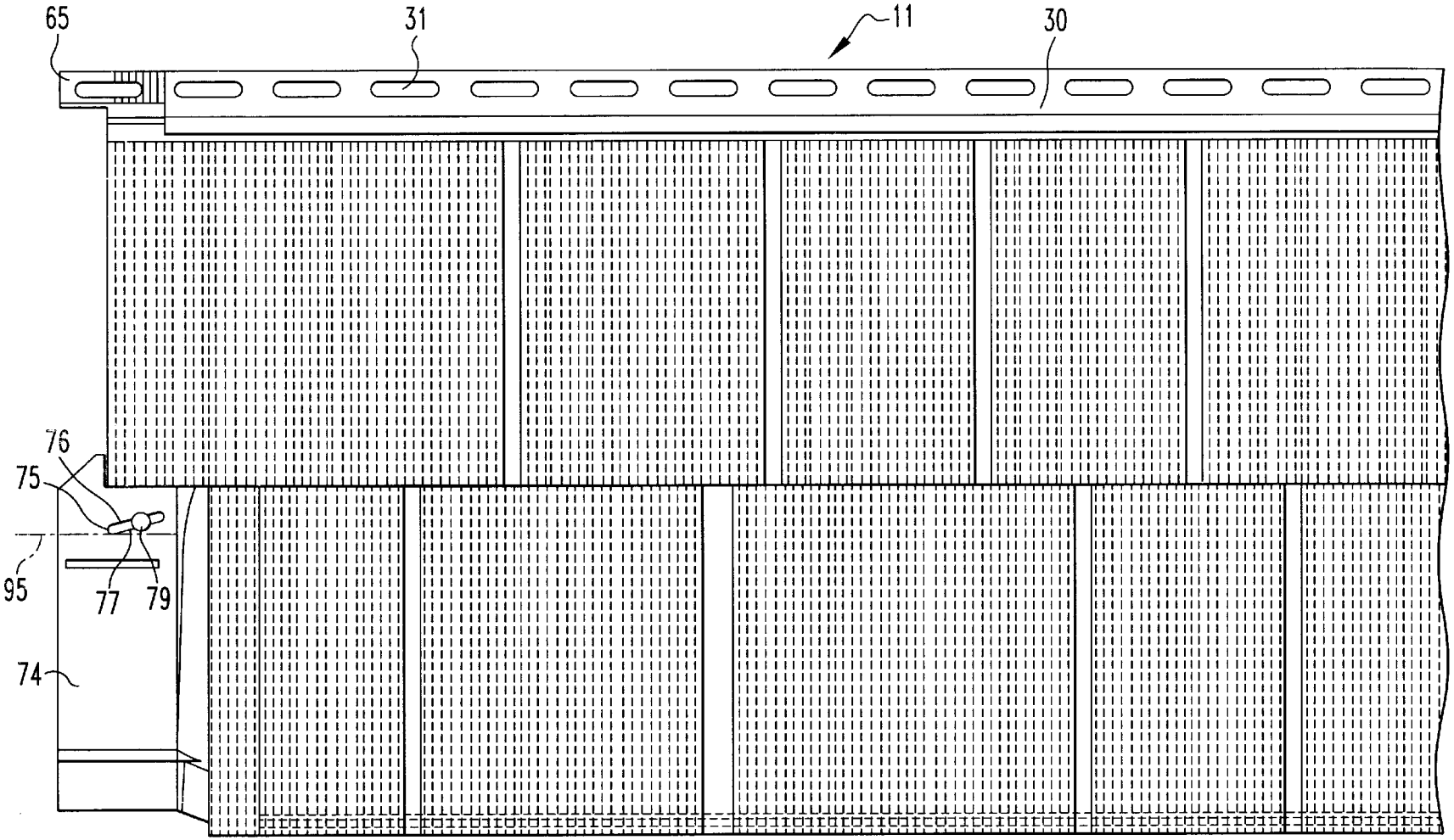
FIG. 12 is an enlarged, fragmentary, front elevational view of the plastic siding panel of FIG. 6.

As shown in FIGS. 2, 3, and 6 the side flange 74 includes a fastening slot or nail slot 75 for nailing the flange 74 to a building wall 10. Referring now to FIG. 12, the preferred fastening slot 75 extends at a predetermined angle of about 10–20° relative to a horizontal axis 95, about 15° in the particularly preferred embodiment shown. The slot 75 is narrow and elongated, extending between opposed, upper and lower marginal edges or edge protions 76, 77. The head 79 of a metal nail or other metal fastener extending through the slot overlaps both the upper and lower marginal edges 76, 77.

Having described the presently preferred embodiments, it is to be understood that the invention may be otherwise embodied within the spirit and scope of the appended claims.

What is claimed is:

1. A plastic panel for attachment to an exterior wall of a building, comprising:

(a) a body including at least one row having a preselected appearance, (b) an attachment hem adjacent an upper portion of said body, said attachment hem defining at least one aperture for a fastener to extend therethrough and into a building wall, and (c) at lease one side flange extending laterally outwardly of said body, said side flange defining a fastening slot for inserting a fastener therethrough to attach said panel to a building wall, wherein said slot extends at an acute angle of about 5–30° relative to horizontal.

2. The plastic panel of claim 1 wherein said fastening slot extends at a predetermined angle of about 10–20° relative to horizontal.

3. The plastic panel of claim 1 wherein said fastening slot extends at a predetermined angle of about 15° relative to horizontal.

4. The plastic panel of claim 1 wherein said fastening slot is narrow and elongated.

5. The plastic panel of claim 1 wherein said body comprises an upper row of simulated shingles and a lower row of simulated shingles below said upper row, said side flange extending laterally outwardly of said lower row.

6. The plastic panel of claim 1 wherein said attachment hem defines a plurality of apertures and at least most of said apertures are horizontally elongated.

7. The plastic panel of claim 1 wherein said fastening slot is elongated and includes opposed, upper and lower marginal edges.

8. The plastic panel of claim 1, further comprising:

a) a locking tab adjacent said attachment hem, and b) a bottom flange attached to a lower portion of said body and comprising a locking lip for engaging a locking tab on an adjacent panel.

9. An exterior wall of a building covered by a plurality of plastic panels, comprising:

a) an exterior wall of a building, b) a plurality of the plastic panels of claim 1, said panels covering at least part of said exterior wall, c) a plurality of metal fasteners extending through apertures in an attachment hem on at least one of said plastic panels and into said exterior wall, d) a metal fastener extending through a fastening slot on a side flange of at least one of said plastic panels, said fastener comprising a head overlapping opposed upper and lower marginal edge portions of said side flange bordering said slot.

* * * * *